US007836550B2

(12) United States Patent
Lin

(10) Patent No.: US 7,836,550 B2
(45) Date of Patent: Nov. 23, 2010

(54) DAMPING HINGE DEVICE

(75) Inventor: Ming-Han Lin, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 421 days.

(21) Appl. No.: 11/965,490

(22) Filed: Dec. 27, 2007

(65) Prior Publication Data

US 2009/0165246 A1 Jul. 2, 2009

(51) Int. Cl.
*E05F 1/08* (2006.01)

(52) U.S. Cl. ..... 16/303; 16/330; 16/337; 188/290

(58) Field of Classification Search ..... 16/330, 16/337, 341, 342, 327, 329, 331, 352, 374, 16/376, 377, 334, 54; 379/433.11, 433.12, 379/433.13; 188/290, 291, 293, 296, 322.5, 188/308

See application file for complete search history.

(56) References Cited

U.S. PATENT DOCUMENTS 4,908,905 A * 3/1990 Kanno et al. ..... 16/82
5,996,132 A * 12/1999 Sorimachi ..... 16/303
6,393,624 B1 * 5/2002 Iwashita ..... 16/54
6,948,217 B2 * 9/2005 Higano et al. ..... 16/303
7,036,186 B2 * 5/2006 Jeong et al. ..... 16/303
7,418,279 B2 * 8/2008 Takagi ..... 16/371
7,484,266 B1 * 2/2009 Yang ..... 16/54
7,509,710 B1 * 3/2009 Lin et al. ..... 16/337
7,510,062 B2 * 3/2009 Derr et al. ..... 188/290

FOREIGN PATENT DOCUMENTS

EP 329788 A1 * 8/1989
JP 01012151 A * 1/1989

* cited by examiner

*Primary Examiner*—Victor Batson
*Assistant Examiner*—Jeffrey O'Brien
(74) *Attorney, Agent, or Firm*—WPAT, P.C.; Anthony King

(57) ABSTRACT

A damping hinge device includes a hinge and a damper. The damper is arranged coaxially with the hinge and has a damping shell, a damping body, a plurality of rotating slices, a plurality of limiting slices, an outer gasket and a pushing body. The damping shell has a cylinder-shaped shell body, a top cover is formed in the top of the shell body. The damping body is accepted in the damping shell and has a basic portion and a column portion extending from one end of the basic portion. The rotating slices are accepted in the damping shell and fixed around the column portion. The limiting slices are fixed in the damping shell and rotatably around the column portion of the damping body, the limiting pieces and the rotating pieces are staggeredly arranged. Damping oil is filled between the adjacent limiting slices and the rotating slices. The outer gasket is disposed on the basic portion of the damping body and pressed against the shell body.

9 Claims, 5 Drawing Sheets

DAMPING HINGE DEVICE

BACKGROUND OF THE INVENTION

1. Field of the Invention

This present invention relates to a hinge device, and more particularly to a damping hinge device preferably applicable to folding or unfolding an electric device such as a folding mobile phone, a portable computer and an electric pocket notebook.

2. The Related Art

Conventionally, a portable apparatus, such as a portable computer and a folding mobile phone, has a body and a display joined by two hinges arranged in two sides of the portable apparatus.

Referring to FIG. 1, a traditional hinge 10 includes a housing 3, a sliding cam 5, a rotating cam 6, a spring 4, a shaft 7, an E-ring 8 and a washer 9. Two curving surfaces 51 are formed in an upper end of the sliding cam 5, the curving surfaces 51 show a V-shape. Two sliding portions 61 are formed in a lower end of the rotating cam 6. The sliding cam 5 and the rotating cam 6 are accepted in the housing 3, the two sliding portions 61 is rotatably against the curving surfaces 51 of the sliding cam 5. The washer 9 covers the bottom of the housing 3. The spring 4 is accepted in the housing 3, one end of the spring 4 is against the washer 9, the other end of the spring 4 is against a lower end of the sliding cam 5. A lower end of the shaft 7 forms a ring-shaped groove, the shaft 7 passes through the rotating cam 6, the sliding cam 5, the spring 4 and the washer 9, and the E-ring 8 is accepted in the ring-shaped groove of the shaft 7.

The rotating cam 6 is fixed with the display of the portable computer, the housing 3 is fixed with the body of the portable computer. Generally, the two traditional hinges 10 are arranged in the two sides of the portable computer to link the body and the display. When the portable computer is unfolded or folded, the sliding portions 61 slides along the curving surfaces 51 quickly to a lower point of the curving surfaces 51, the rotating speed of the display around the body is quick, the display and the body are easy to be destroyed. If the traditional hinge 10 is arranged in a folding mobile phone, when the folding mobile phone is unfolded or folded, a display will strike a body of the folding mobile phone, the folding mobile phone will fall off the hand of the user carelessly.

SUMMARY OF THE INVENTION

Accordingly, an object of the invention is to provide a damping hinge device which meets the technical requirements in the above-mention hinge.

The damping hinge device arranged in a folding electric device includes a hinge and a damper. The hinge is adapted for producing and releasing an elastic force by rotating. The damper is arranged coaxially with the hinge and has a damping shell, a damping body, a plurality of rotating slices, a plurality of limiting slices, an outer gasket and a pushing body. The damping shell has a cylinder-shaped shell body and a top cover being formed in the top of the shell body. The damping body is received in the shell body of the damping shell and has a basic portion and a column portion extending from one end of the basic portion. The rotating slices and the limiting slices are received in the shell body of the damping shell. And the rotating slices and the limiting slices are alternately disposed on the column portion, the rotating slices are fixed to the damping body, while the limiting slices are fixed to the damping shell. Damping oil is filled between the adjacent limiting slices and the rotating slices. The outer gasket is disposed on the basic portion of the damping body and pressed against the shell body of the damping shell. One end of the pushing body engages with the hinge for rotating together with the hinge, the other end of the pushing body selectively engages with the damping body for pushing the damping body together with the rotating slices to rotate when the elastic force of the hinge is released.

As described above, by the cooperation of the rotating slices, the limiting slices and the damping oil filled between the adjacent rotating slices and the limiting slices, when the pushing body pushes the damping body, the damping body rotates more softly, then the electric device can be unfolded or folded more reliably.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 2:
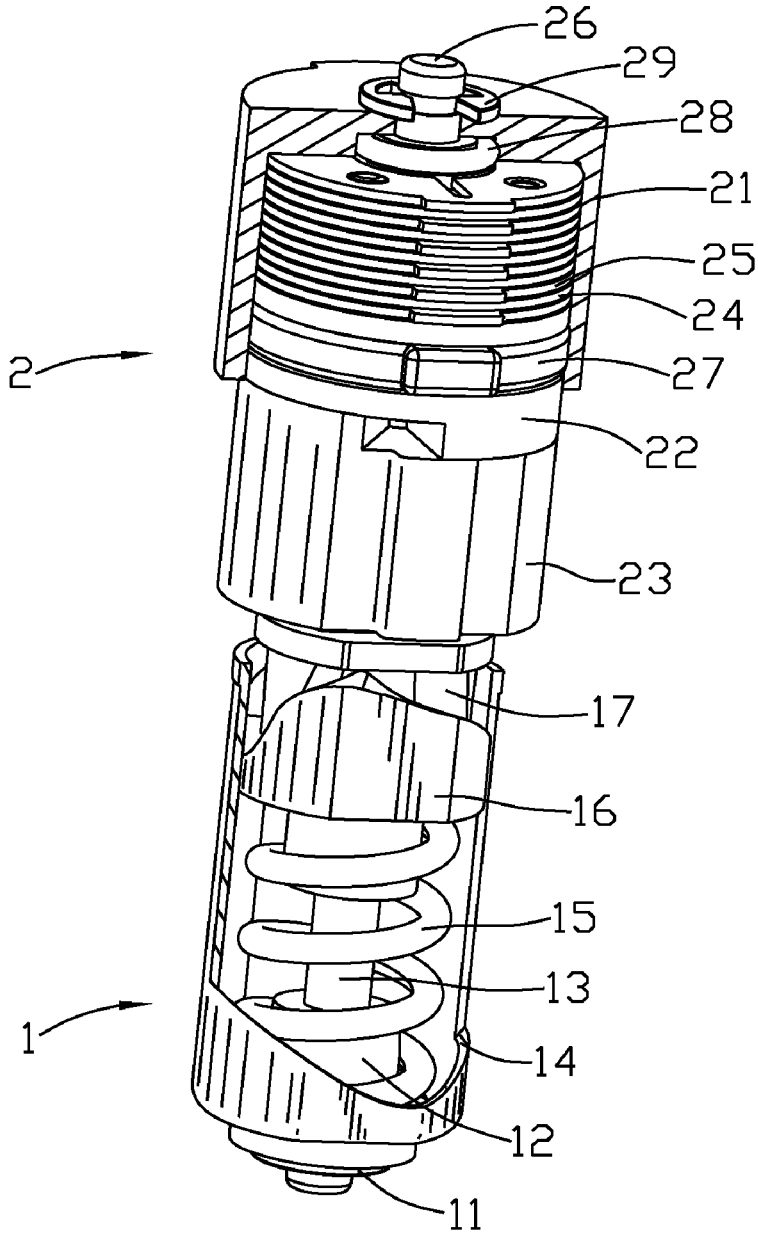
FIG. 2 is a perspective view of a damping hinge device according to the present invention, a damping shell and a housing of the damping hinge device are dissected partly.
Figure 3:
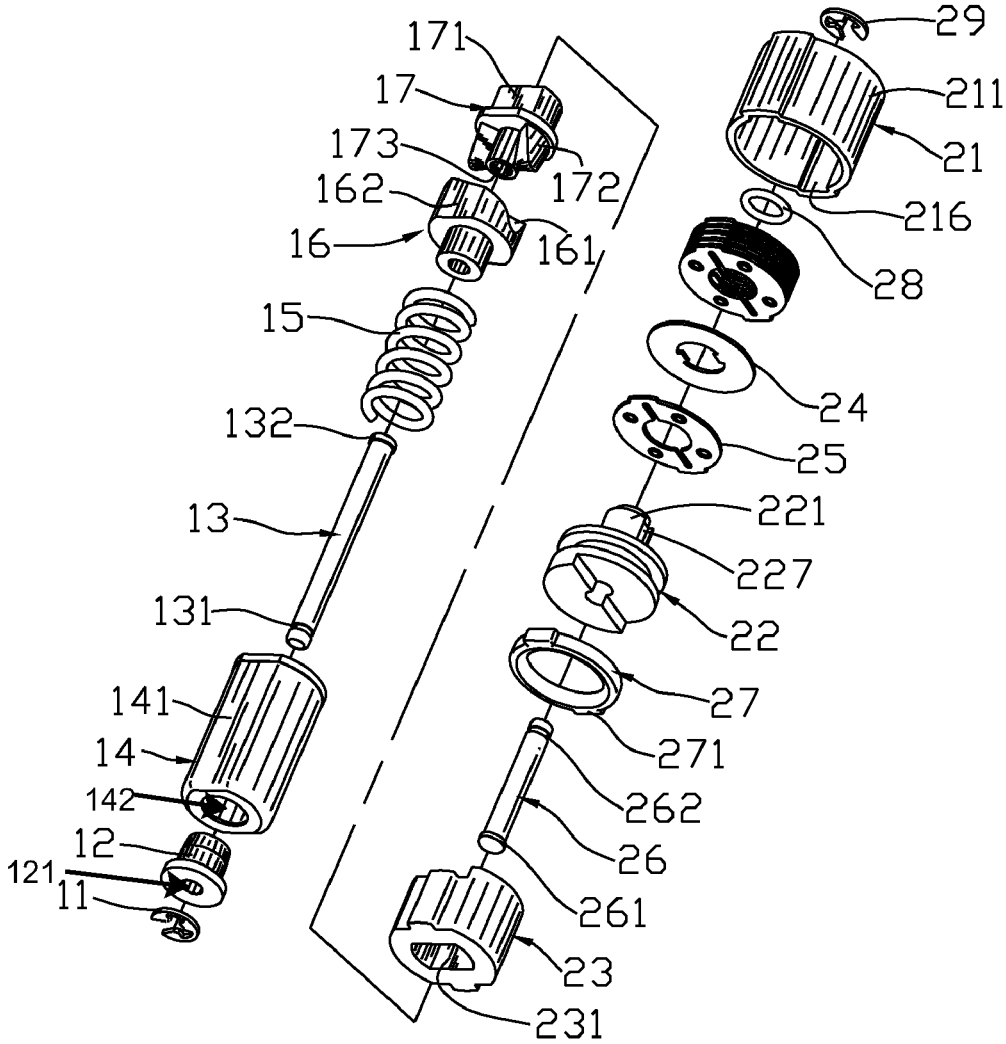
FIG. 3 is an exploded perspective view of the damping hinge device in FIG. 2.

Please refer to FIGS. 2, and 3, a damping hinge device 100 according to the invention is shown. The damping hinge device 100 includes a hinge 1 and a damper 2.

The damper 2 includes a pushing body 23, a damping body 22 resisting on the pushing body 23, a plurality of rotating slices 24 and limiting slices 25 disposed on the damping body 22 and a damping shell 21. The damping body 22, the rotating slices 24 and the limiting slices 25 are accepted in the damping shell 21. A top end of a damping shaft 26 passes through the pushing body 23, the damping body 22 and the damping shell 21.

Figure 4:
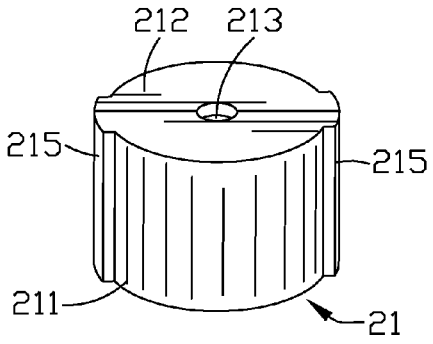
FIG. 4 is a perspective view showing the damping shell of the damping hinge device in FIG. 3.
Figure 5:
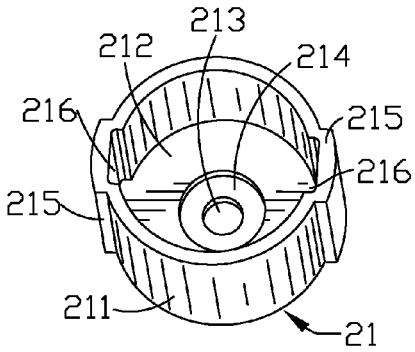
FIG. 5 is another perspective view of the damping shell in FIG. 4.

In FIGS. 4 and 5, the damping shell 21 has a shell body 211 showing a cylinder shape, a top cover 212 forms in the top of the shell body 211 to seal the top of the shell body 211. An axial hole 213 is opened in the middle of the top cover 212. An inner side of the top cover 212 sinks to form a ring-shaped inner groove 214 around the axial hole 213. An outer side of the shell body 211 projects outward to form two limiting lumps 215, the limiting lumps 215 can be fixed in an electric device to prevent the damping shell 21 rotating. Two limiting grooves 216 are formed in an inner side of the shell body 211 and according to the limiting lumps 215.

Figure 6:
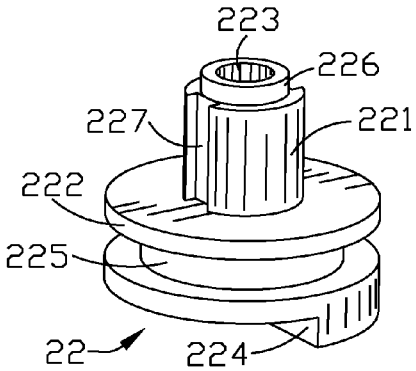
FIG. 6 is a perspective view of a damping body of the damping hinge device in FIG. 3.
Figure 7:
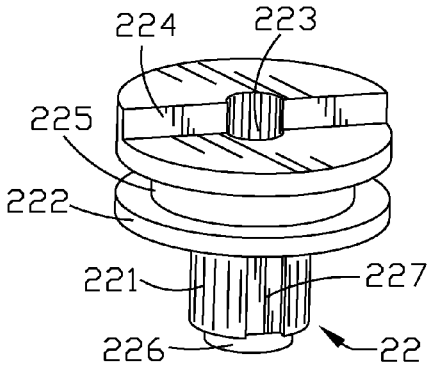
FIG. 7 is another perspective view of the damping body in FIG. 6.

In FIGS. 5, 6 and 7, the damping body 22 is arranged in the damping shell 21. The damping body 22 has a column portion 221 showing a column shape. An outer surface of the column portion 221 sinks inward to form two clicking slots 227 symmetrically, the clicking slots 227 are parallel with the axial of the damping body 22. The bottom of the column portion 221 extends downward to form a basic portion 222, the diameter of the basic portion 222 is larger than the diameter of the column portion 221. A side surface of the basic portion 222 sinks inward to form a ring-shaped groove 225, the bottom surface of the basic portion 222 projects downward to form a fan-shaped lump 224. An axle hole 223 is opened in the damping body 22 and passes through the column portion 221 and basic portion 222 along the axle of the damping body 22. A top end of the column portion 221 projects upward to form a projection part 226 around the axle hole 223. The projection part 226 is accepted in the ring-shaped inner groove 214 of the damping shell 21.

Figure 8:
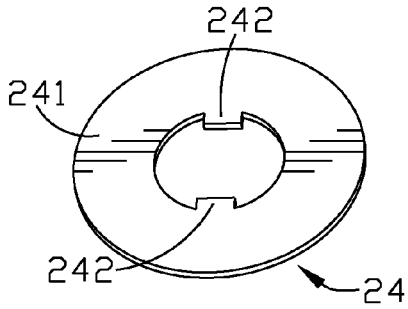
FIG. 8 is a perspective view of a rotating slice of the damping hinge device in FIG. 3.
Figure 9:
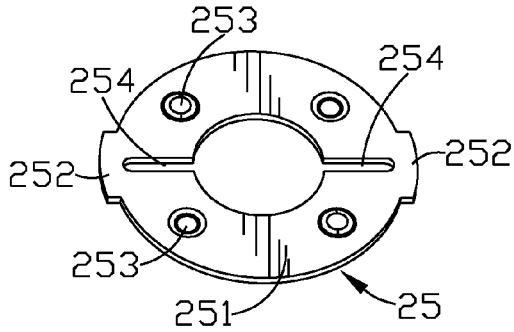
FIG. 9 is a perspective view of a limiting slice of the damping hinge device in FIG. 3.

Referring to FIGS. 3, 8 and 9, the rotating slices 24 and the limiting slices 25 are staggeredly disposed around the column portion 221. The rotating slices 24, the limiting slices 25 and the damping body 22 are accepted in the damping shell 21. The rotating slice 24 has a ring-shaped flake 241, An inner side of the ring-shaped flake 241 extends inward to form two fixing flakes 242 facing each other. The fixing flakes 242 are accepted in the clicking slots 227 of the damping body 22, so the rotating slices 24 can rotate together with the damping body 22. The limiting slice 25 has a ring-shaped piece 251, an outer side of the ring-shaped piece 251 extends outward to form two fixing pieces 252 opposite to each other. The fixing pieces 252 are accepted in the limiting grooves 216 of the damping shell 21, so the limiting slices 25 cannot rotate in the damping shell 21. The ring-shaped piece 251 projects downward and upward to form a plurality of projections 253, the projections 253 are against the ring-shaped flake 241 of the rotating slice 24, so a space is formed between the rotating slice 241 and the limiting slice 25. In this embodiment, the projections 253 show a spherical surface shape and are centrosymmetric. Two gaps 254 are opened in the ring-shaped piece 251.

Figure 10:
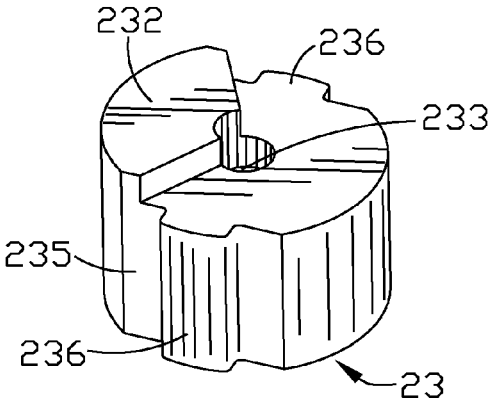
FIG. 10 is a perspective view of a pushing body of the damping hinge device in FIG. 3.
Figure 11:
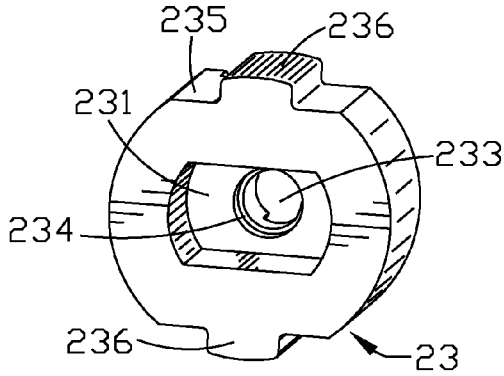
FIG. 11 is another perspective view of the pushing body.

Please refer to FIGS. 6, 10 and 11, the pushing body 23 shows a column shape. The bottom of the pushing body 23 dents upward to form a connecting groove 231, the top of the pushing body 23 projects upward to form a projecting platform 232 showing a fan-shaped shape at one side thereof. The projecting platform 232 is disposed between two opposite ends of the fan-shaped lump 224. The middle of the top of the pushing body 23 defines a middle hole 233 connecting the connecting groove 231. A projecting circle 234 protrudes inward from an inner side of the middle hole 233. An outer side of the pushing body 23 is cut partly to form two limiting planes 235. The two limiting planes 235 are arranged symmetrically. Two limiting strips 236 project from the limiting planes 235. The limiting planes 235 and the limiting strips 236 are used to fasten the pushing body 23 in the electric device firmly and make the pushing body 23 rotate together with the electric device.

In FIGS. 2 and 3, the bottom of the damping shaft 26 projects outward to form a projecting ring 261, a ring-shaped slot 262 is opened in the top of the damping shaft 26. When the damping shaft 26 extends into the pushing body 23, the projecting ring 261 is against the projecting circle 234, the top of the damping shaft 26 passes through the middle hole 233 of the pushing body 23, the axle hole 223 of the damping body 22 and the axial hole 213 of the damping shell 21 to extend out of the damping shell 21, the ring-shaped slot 262 is exposed outside the top cover 212 of the damping shell 21, a C-ring 29 is accepted in the ring-shaped slot 262 of the damping shaft 26 and against the top cover 212 of the damping shell 21, so the pushing body 23, the damping body 22 and the damping shell 21 are assembled together.

Refer to FIGS. 3, 5 and 7, an outer gasket 27 is disposed in the ring-shaped groove 225 of the damping body 22. The outer gasket 27 has two protruding blocks 271 which can be accepted in the limiting grooves 216 of the damping shell 21 precisely. While the damping body 22 assembled with the outer gasket 27 is accepted in the damping shell 21, the outer gasket 27 is against the inner side of the shell body 211. An inner gasket 28 is covered around the projection part 226, when the damping body 22 is accepted in the damping shell 21, the inner gasket 28 is pressed in the ring-shaped inner groove 214. So a sealing space is formed between the damping shell 21 and the damping body 22, and damping oil is filled in the sealing space. Because of the projections 253 and the gaps 254 defined in the limiting slice 25, the damping oil can be filled between the adjacent rotating slice 24 and limiting slice 25.

Figure 1:
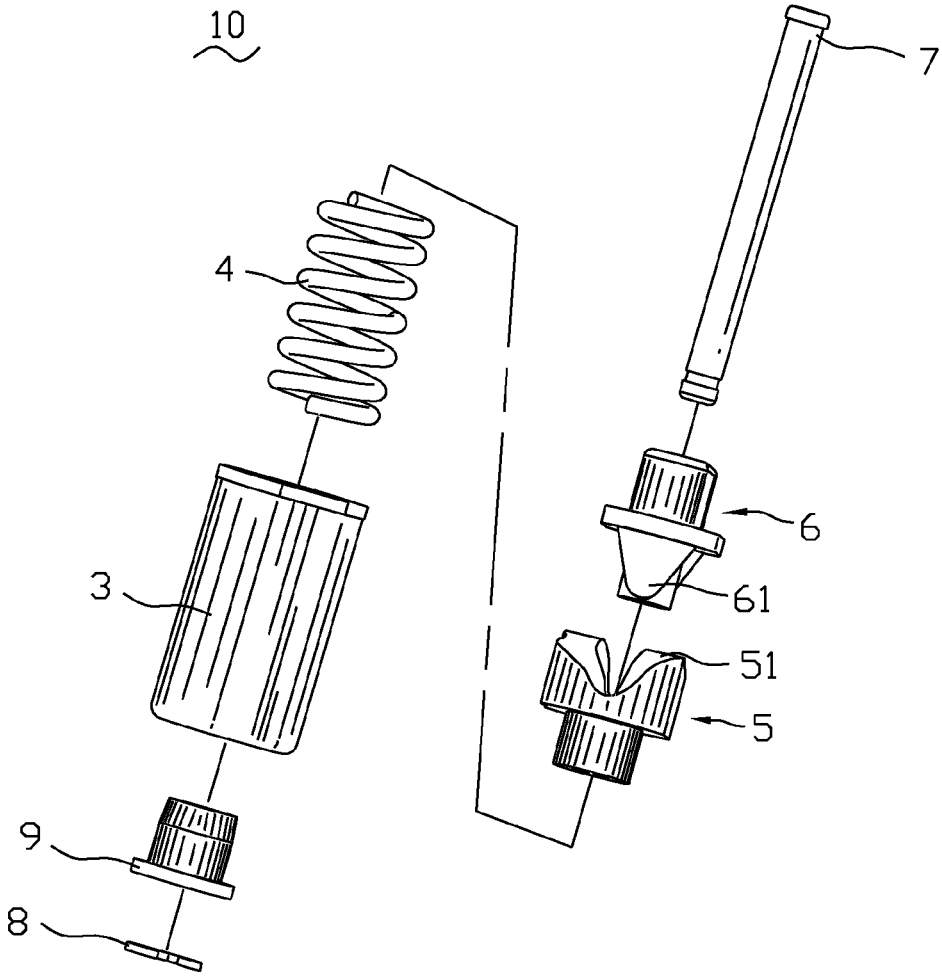
FIG. 1 (Prior Art)
FIG. 1 is an exploded perspective view of a traditional hinge.

In FIGS. 2 and 3, the hinge 1 includes an E-ring 11, a washer 12, a middle shaft 13, a housing 14, a spring 15, a sliding cam 16 and a rotating cam 17 arranged on the sliding cam 16. The hinge 1 is similar to the traditional hinge 10 in FIG. 1. Two limiting sides 141 are formed in the outside of the housing 14. A circular opening 142 is opened in the bottom of the housing 14. A column-shaped aperture 121 is arranged in the washer 12 lengthwise.

The washer 12 is inserted in the circular opening 142 and against the bottom of the housing 14. The spring 15 is accepted in the housing 14 and above the washer 12. The sliding cam 16 is accepted in the housing 14 and above the spring 15. The top of the sliding cam 16 has two curving surfaces 161. Two stop sides 162 are formed in the side of the sliding cam 16 and resist the inside of the limiting sides 141. An aperture (not shown) is opened along an axial of the sliding cam 16. An upper end of the rotating cam 17 forms a connecting portion 171, a lower end of the rotating cam 17 forms two sliding portions 172, the sliding portion 172 shows a V-shape, an axial hole 173 is opened in the rotating cam 17 from top to bottom. The sliding portions 172 resist the curving surfaces 161. The middle shaft 13 shows a longwise column shape, a ring-shaped notch 131 is opened in the bottom of the middle shaft 13, a protruding ring 132 is formed in the top of the middle shaft 13. For the diameter of the protruding ring 132 is larger than the diameter of the axial hole 173, the protruding ring 132 is against the top of the rotating cam 17. The bottom of the middle shaft 13 passes through the axial hole 173 of the rotating cam 17, the aperture 163 of the sliding cam 16, the spring 15, the circular opening 142 of the housing 14 and the column-shaped aperture 121 of the washer 12, then the E-ring 11 is located in the ring-shaped notch 131.

In this embodiment, the connecting portion 171 is accepted firmly in the connecting groove 231 of the pushing body 23 while the damping hinge device 100 is arranged in the electric device. The pushing body 23 is arranged in a display of the electric device, the housing 14 and the damping shell 21 are arranged in a base of the electric device.

When the electric device is unfolded or folded, the pushing body 23 rotates with the display, the pushing body 23 drives the rotating cam 17, the sliding portions 172 slide along the rising portions of the curving surfaces 161 of the sliding cam 16 respectively, then the sliding portions 172 slide along the dropping portions of the curving surfaces 161 respectively, the projecting platform 232 resists and drives the fan-shaped lump 224, so the damping body 22 rotates in the damping shell 21, the damping body 22 drives the rotating slices 24 to rotate relative to the limiting slices 25 and the damping shell 21. For the adhesive force of the damping oil filled between the rotating slices 24 and the limiting slices 25, the damping body 22 rotates in the damping shell 21 slowly.

In another embodiment, the housing 14 and the connecting portion 171 of the rotating cam 17 are arranged in the base and the display symmetrically, and the pushing body 23 and the damping shell 21 are arranged in the base and the display. The limiting sides 141 are used to fasten the housing 14 in the electric device.

As described above, by the cooperation of the rotating slices 24, the limiting slices 25 and the damping oil filled between the adjacent rotating slices 24 and the limiting slices 25, when the pushing body 23 pushes the damping body 22, the damping body 22 rotates more softly, then the electric device can be unfolded or folded more reliably.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A damping hinge device, comprising:

a hinge adapted for producing and releasing an elastic force by rotating; and a damper arranged coaxially with the hinge, the damper having a damping shell having a cylinder-shaped shell body and a top cover formed in the top of the shell body, a damping body received in the shell body of the damping shell, the damping body having a basic portion and a column portion extending from one end of the basic portion, a plurality of rotating slices and a plurality of limiting slices received in the shell body of the damping shell, the rotating slices and the limiting slices being alternately disposed on the column portion, the rotating slices being fixed to the damping body, while the limiting slices being fixed to the damping shell, damping oil being filled between the adjacent limiting slices and the rotating slices, an outer gasket disposed on the basic portion of the damping body and pressed against the shell body of the damping shell, and a pushing body, one end of the pushing body engaging with the hinge for rotating together with the hinge, the other end of the pushing body selectively engaging with the damping body for pushing the damping body together with the rotating slices to rotate when the elastic force of the hinge being released.

2. The damping hinge device as set forth in claim 1, wherein an outer surface of the column portion sinks inward to form two clicking slots, the rotating slice has a ring-shaped flake, an inner side of the ring-shaped flake extends inward to form two fixing flakes locked in the clicking slots.

3. The damping hinge device as set forth in claim 1, wherein an inner side of the shell body defines two limiting grooves, each of the plurality of limiting slices has a ring-shaped piece, an outer side of the ring-shaped piece extends outward to form two fixing pieces locked in the limiting grooves.

4. The damping hinge device as set forth in claim 3, wherein the ring-shaped piece projects downward and upward to form a plurality of projections for resisting the adjacent ring-shaped flakes.

5. The damping hinge device as set forth in claim 4, wherein the projection shows a spherical surface shape.

6. The damping hinge device as set forth in claim 4, wherein the ring-shaped piece of each liming slice defines at least one gap.

7. The damping hinge device as set forth in claim 1, wherein the top cover of the damping shell defines an axial hole, an inner side of the top cover sinks to form a ring-shaped inner groove around the axial hole, the damper further comprises an inner gasket disposed on the top of the column portion and pressed in the ring-shaped inner groove.

8. The damping hinge as set forth in claim 7, the damper further comprises a damping shaft, one end of the damping shaft is fixed inside the pushing body, the other end of the damping shaft passes through the damping body, the inner gasket and the top cover of the damping shell, and is locked with the top cover.

9. The damping hinge device as set forth in claim 1, wherein a bottom of the basic portion projects downward to form a lump at one side thereof, a top of the pushing body projects upward to form a projecting platform at one side thereof, the projecting platform rotates between two opposite sides of the lump for selectively engaging or disengaging with the lump.

* * * * *